United States Patent [19]

Glenn

[11] 3,941,500

[45] Mar. 2, 1976

[54] TURBOMACHINE INTERSTAGE SEAL ASSEMBLY

[75] Inventor: Robert G. Glenn, Huntingdon Valley, Pa.

[73] Assignee: Westinghouse Electric Corporation, Pittsburgh, Pa.

[22] Filed: Mar. 27, 1975

[21] Appl. No.: 562,614

Related U.S. Application Data

[63] Continuation-in-part of Ser. No. 478,129, June 10, 1974, abandoned.

[52] U.S. Cl. ..... 415/136; 415/172 A; 277/53

[51] Int. Cl.[2] ..... F16J 15/50

[58] Field of Search ..... 415/110, 112, 136, 171, 415/169, 170, 172, 115, 116; 277/53, 174

[56] References Cited

UNITED STATES PATENTS

| | | | |
|---|---|---|---|
| 2,738,949 | 3/1956 | Wilkinson | 415/115 |
| 3,411,794 | 11/1968 | Allen | 277/53 |
| 3,529,904 | 9/1970 | Scalzo et al. | 415/136 |
| 3,829,233 | 8/1974 | Scalzo et al. | 415/136 |

*Primary Examiner*—Henry F. Raduazo
*Attorney, Agent, or Firm*—F. A. Winans

[57] ABSTRACT

A simplified interstage seal assembly for a turbomachine utilizing an abradable semicircular seal slidably held radially inwardly of a stator shroud by a pair of semicircular seal holders. The seal holders are retained between radially depending flanges of shroud segments, with each holder having a key portion projecting through radial slots in the flanges for guided radial expansion or contraction. The holders, after insertion of the keys in the slots, are spatially separated a predetermined distance and maintained in the separated and engaged position by engagement of a seal ring which is supported in the seal holders, in a track and channel arrangement, with a portion of the seal ring disposed in the space between the opposed seal holders to prevent axial displacement of the seal holders and thereby retain the key portions thereof within the slots of the flange.

4 Claims, 3 Drawing Figures

TURBOMACHINE INTERSTAGE SEAL ASSEMBLY

CROSS REFERENCE TO RELATED APPLICATION

This is a continuation in part of copending application Ser. No. 478,129, filed June 10, 1974 and assigned to the same assignee as this application, now abandoned.

BACKGROUND OF THE INVENTION

1. Field of the Invention

This invention relates generally to turbomachines, and more particularly to an interstage seal assembly for a turbine or a compressor.

2. Description of the Prior Art

Turbomachines having bladed diaphragms with inner shroud segments supporting seal assemblies between stages of the rotor are well known in the prior art. Generally such sealing structure accommodates large transient thermal growths inherent in the machine, by being mounted to the shroud segments in a manner that constrains the seal to remain concentric with the rotor (i.e., prevents the sealing assembly from floating) yet permits concentric expansion and contraction. This is readily accomplished by having the seal holding structure define a plurality of cooperating radially extending guide slots angularly separated so that the seal holders having keys matingly received within the slots are prevented from floating movement. In practice it is preferred to have at least three such angularly disposed slots for receiving three mating keys in each separate arcuate segment of the seal holders.

Since the mating guide slots and keys engage only when they are properly concentric, they are, of necessity, assembled by placing them in such concentric orientation and then moving them towards each other axially to assume their engaged position. The seal holder in turn defines structure cooperating with a seal ring so that the seal ring can be slid circumferentially to its proper position and locked there as by a set screw or indexing pin.

As each half of the shroud is assembled in this manner, a complete circular seal holder and seal ring is provided when the two halves are secured together.

Seal holding assemblies typical of the above are shown in U.S. Pat. Nos. 3,529,904 and 3,829,233 having a common assignee as the present application. However, in each of the structures shown by these patents it is seen that the axial retention of the key or pin, associated with the seal holder so that it remains within the radial slot of the flange to prevent unrestrained circumferential movement of the seal holder and radial displacement to a position permitting nonconcentricity with the rotor, requires separate structure specifically and solely for this purpose, i.e., pin 51 in U.S. Pat. No. 3,529,904 patent, which results in a multiplicity of parts and complexity of assembly eliminated by the present invention.

SUMMARY OF THE INVENTION

The present invention provides a pair of axially opposed seal holders disposed between axially opposed radially directed flanges of the inner shroud segments. Each flange contains a plurality of radial slots and each seal holder defines a flange-abutting face having axially outwardly extending keys for receipt within the slots. In such position the opposed seal holder define a definite space dimension between them. The seal holders also define axially open channels for receipt, by circumferential sliding, of engaging tongue portions of a mating seal ring. The seal ring also includes an intermediate spacing rib sized so as to be received within the space of the opposed seal holders so that the seal ring itself prevents axial movement, to a disengaged position, of the assembled seal holders.

DESCRIPTION OF THE PREFERRED EMBODIMENT

Figure 1:
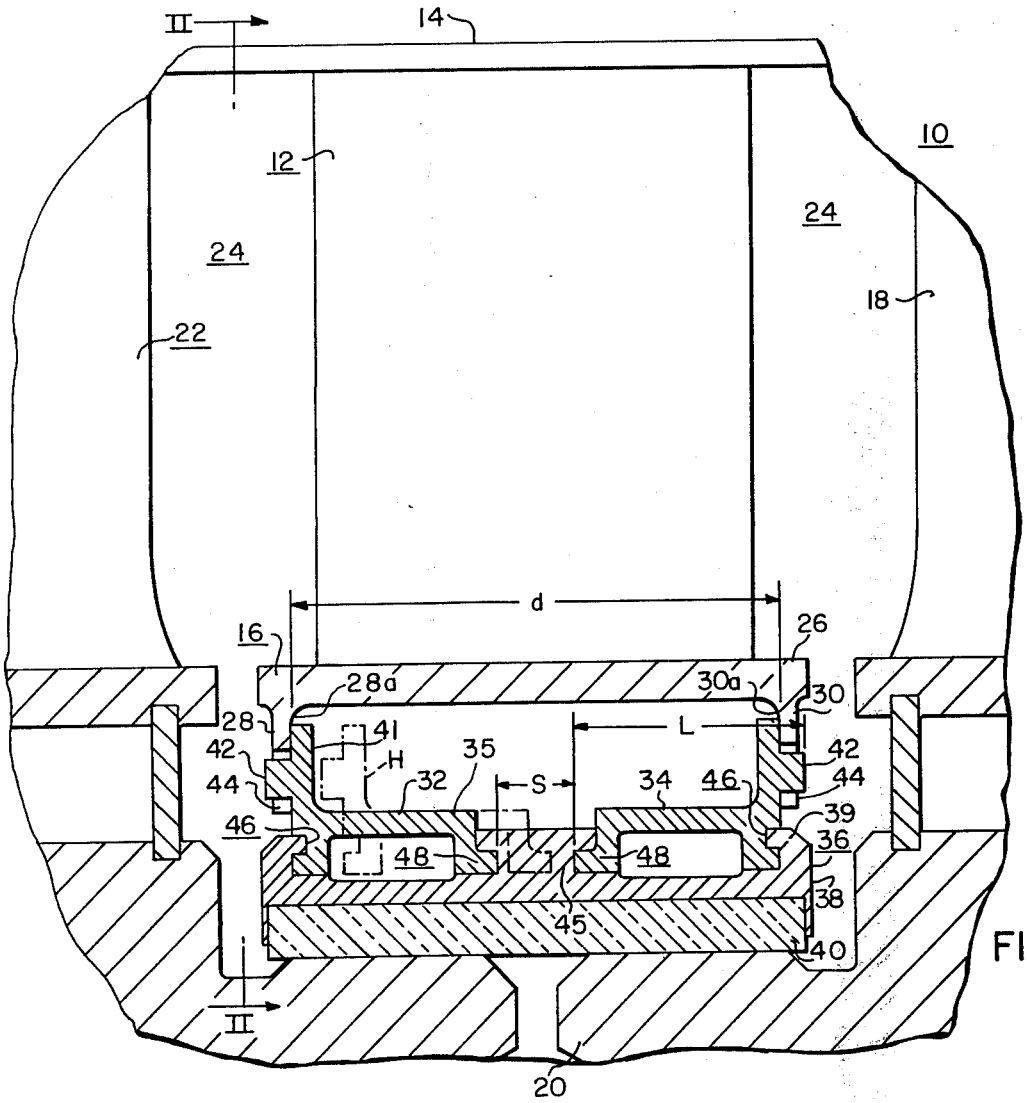
FIG. 1 is a longitudinal partial sectional view of an inner shroud area of a turbomachine having an inner seal assembly in accordance with the present invention.

Referring initially to FIG. 1, the structure shown therein comprises a portion of an axial flow turbomachine 10 which may be a turbine or a compressor. The turbomachine 10 includes an annular array of circumferentially spaced stationary blades or vanes 12, secured between arcuate outer shroud segments 14, and arcuate inner shroud segments 16. The outer shroud segments 14 are mounted in a stator blade ring, not shown disposed inside with the turbomachine casing, also not shown, which is generally circular in cross section.

An annular row of rotor blades may be disposed intermediately downstream from the stationary blades 12. The rotor blades 18 are suitably attached to the periphery of a rotor disc 20. The rotor disc 20 is secured to a shaft, not shown, rotatably mounted in the turbomachine. The stationary blades 12 and the rotor blades 18 constitute one stage of the turbomachine 10, which may also include other rotary blades 22 and stationary blades, similar to the ones shown, thereby providing a multistage turbine or compressor.

An elastic fluid is supplied to the turbomachine 10, from suitable combustion chambers if the turbomachine is a turbine, or from an inlet orifice if the turbomachine 10 is compressor. The elastic fluid passes through an annular passageway 24, guided by and acting in conjunction with the stationary rotor blades 12 and 18 of the turbomachine 10.

The inner shroud segment 16 has the function of preventing the elastic fluid from escaping from the annular passageway 24 and bypassing the stationary blades or vanes 12.

The inner shroud segment 16 comprises a platform portion 26 having a pair of radially inwardly directed annular flanges 28, 30 in axially opposed spaced relationship of predetermined axial dimension d between the facing portions **28*a*, 30*a***.

Figure 3:
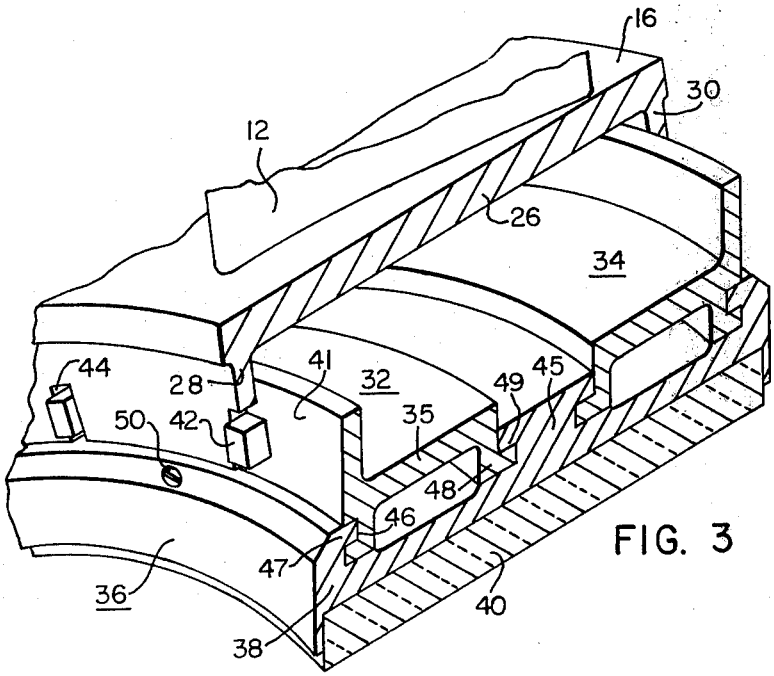
FIG. 3 is an isometric view of a portion of the seal assembly.
Figure 2:
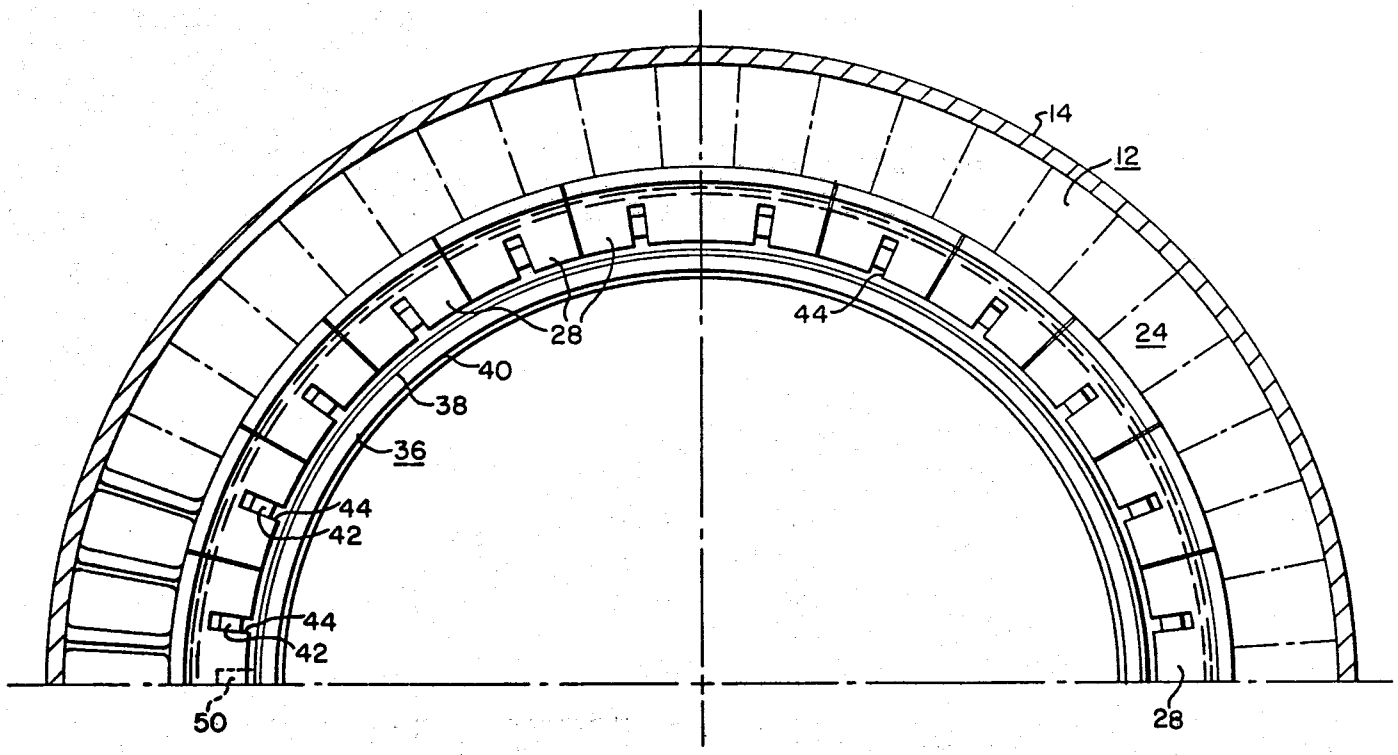
FIG. 2 is a view taken along lines II—II of FIG. 1.

Referring now to FIG. 1 in conjunction with FIGS. 2 and 3 it is seen that each flange defines a plurality of radially inwardly open slots 44 equiangularly positioned about the annular extent thereof. (It is evident that for interchangeability of the components of the top half with the components of the lower half of the shroud each respective semicircular portion should contain at least two such slots, however, in the preferred embodiment, such slots are provided on 15° intervals.)

A pair of axially opposed seal holders 32, 34 are disposed within the space between the opposed flanges 28, 30, with one seal holder being the mirror image of the other and comprising a generally planar face 41 for abutting engagement with the innerface 28*a* of the flange and having a portion 42 projecting axially therefrom for guided receipt in the respective slots 44. The lower portion of the face 41 is notched as at 46 to provide, over its arcuate extent, a channel. Each seal holder 32, 34 further defines a portion 35 extending axially from the face 41 which terminates in a step configuration 48 providing an arcuate tongue portion.

The respective seal holders are mounted on the flanges 28, 30 by first circumferentially and radially aligning the projections 42 with the slots 44 as shown in dotted outline H, and then moving them axially to their final engaged position. It is evident that to accomplish this, first one seal holder can be inserted and then the second seal holder inserted with the only requirement being that the overall axial dimension L of the last to be inserted cannot exceed the distance between the terminal end 48 of the first inserted holder and the opposite face 30*a* of the flange to allow sufficient space for the last inserted to be moved into position. Once both seal holders are in their respective proper positions, there is defined between their respective opposed terminal ends a space of predetermined dimension S.

A seal ring 36 is mounted on and supported from the seal holders 32, 34 through a seal mounting member 38 extending across the axial extent of the opposed seal holders, and terminating in upwardly directed flanges 39 having inturned tongue portions 47 for circumferential sliding receipt in the channels 46.

The seal mounting portion also includes an intermediate upwardly directed rib 45 that abuts the respective terminal ends 48 of the seal holders to prevent the axial displacement of the seal holder subsequent to the mounting portion being assembled thereto. In the instant embodiment the rib is undercut as at 49 to provide a track for sliding receipt of the tongue 48 of the seal holders to provide an interengagement that generally assures proper alignment of the assembled parts and prevents a skewed assembly. The seal ring also includes a sealing portion 40 seated within the mounting member 38. In this preferred embodiment the sealing portion is an abradable member in facing sealing engagement with the rotor disc.

Thus, it is seen, a seal assembly is shown that includes a pair of seal holders properly sized for insertion between opposing flanges of the inner shroud segments, with the holders defining projections received in slots in the flanges for insuring concentric expansion or contraction, and the projecting portions of the holders maintained in such engagement within the slots, against axial displacement, by a portion of the seal ring, which when circumferentially slid into place, generally locks the assembly together through cooperating tongue and channel engagement and a center rib abutting the spaced terminal ends of the seal holders. To complete the assembly prior to bolting or securing the two halves of the shroud together, a well known pin or set screw 50 is used to secure the seal ring to at least one seal holder to prevent relative circumferential movement between them.

I claim as my invention:

1. In an axial flow turbomachine having an annular array of stator vanes with inner shroud segments secured to said vanes, a rotor disc radially inwardly of said shroud segments and supporting an annular array of rotor blades disposed axially adjacent said stator vanes, and a seal assembly disposed between said inner shroud segments and said rotor disc, said assembly comprising:

a pair of opposed flange members extending radially inwardly from said shroud segments, and separated a predetermined axial dimension, with each of said flange members defining radially extending slots;

a pair of seal ring holding members disposed within the axial dimension between said opposed flange members, each holding member having a face defining an axially extending key portion for receipt within an aligned slot in said flange with said face abutting said flange, and an opposite terminal end, with said terminal ends of each pair being axially spatially separated a predetermined distance;

a seal ring comprising a sealing member for facing contact with said rotor disc and means for mounting said sealing member on said holding members, said mounting means in cooperation with said seal ring holding members providing complimentary track and channel engagement, said mounting means further defining a radially extending portion disposed between the opposed terminal ends of said seal ring holding members to limit the axial movement of each holding member to less than the axial dimension of the key portion;

whereby, after the seal ring is circumferentially slid into position on said seal holding members, said keys of said seal holding members are prevented from axial disengagement from within the slots of said flanges; and, means for attaching the seal ring to at least one of said seal holding members to prevent circumferential movement of one with respect to the other.

2. Structure according to claim 1 wherein said radially extending portion of said mounting means has an axial dimension substantially equal to the predetermined distance between said terminal ends of said seal ring holding members in axial alignment for receipt therein to maintain said face of each of said holding members in abutting relation with the adjacent flange member.

3. Structure according to claim 2 wherein the adjacent portions of each of the terminal ends of said holding member and said radially extending portion of said mounting means are cooperatively contoured to provide an interengaging tongue and groove relationship therebetween.

4. Structure according to claim 3 wherein said holding members are dimensioned such that the combined axial extent of said opposed pair of members, from said face to the terminal end of each, is less than said predetermined axial dimension by at least the axial extent of said key portion whereby the last-to-be-inserted holding member can be moved into proper aligned orientation between said opposed flanges without interference and subsequently moved axially into proper position with said face abutting said adjacent flange and said key portions received within said slots.

* * * * *